US010998624B2

(12) United States Patent
Zhang

(10) Patent No.: US 10,998,624 B2
(45) Date of Patent: May 4, 2021

(54) ANTENNA WITH RECONFIGURABLE BEAM DIRECTION AND ANTENNA ARRAY WITH RECONFIGURABLE BEAM SCANNING RANGE

(71) Applicant: WUHAN SYNTEK LTD., Wuhan (CN)

(72) Inventor: Kefeng Zhang, Wuhan (CN)

(73) Assignee: WUHAN SYNTEK LTD., Wuhan (CN)

( * ) Notice: Subject to any disclaimer, the term of this patent is extended or adjusted under 35 U.S.C. 154(b) by 228 days.

(21) Appl. No.: 16/210,638

(22) Filed: Dec. 5, 2018

(65) Prior Publication Data

US 2019/0115655 A1 Apr. 18, 2019

Related U.S. Application Data

(63) Continuation of application No. PCT/CN2016/084970, filed on Jun. 6, 2016.

(51) Int. Cl.

| | |
|---|---|
| ***H01Q 3/01*** | (2006.01) |
| ***H01Q 15/20*** | (2006.01) |
| ***H01Q 21/20*** | (2006.01) |
| ***H01Q 1/38*** | (2006.01) |

(52) U.S. Cl.
CPC ..... *H01Q 3/01* (2013.01); *H01Q 1/38* (2013.01); *H01Q 21/20* (2013.01)

(58) Field of Classification Search
CPC .. H01Q 1/24; H01Q 1/38; H01Q 3/01; H01Q 21/20
USPC ..... 343/702
See application file for complete search history.

(56) References Cited

U.S. PATENT DOCUMENTS

| | | | | |
|---|---|---|---|---|
| 3,599,218 A * | 8/1971 | Williamson | ..... | H01Q 15/163 343/840 |
| 4,352,112 A | 9/1982 | Leonhardt et al. | | |
| 4,689,637 A * | 8/1987 | Ochiai | ..... | H01Q 19/132 343/840 |

(Continued)

FOREIGN PATENT DOCUMENTS

| | | |
|---|---|---|
| CN | 105846079 A | 8/2016 |
| CN | 205692960 U | 11/2016 |
| JP | 2013072815 A | 4/2013 |

OTHER PUBLICATIONS

Internation Search Report of PCT/CN2016/084970, dated Feb. 17, 2017.

*Primary Examiner* — Tho G Phan
(74) *Attorney, Agent, or Firm* — True Shepherd LLC; Andrew C. Cheng

(57) ABSTRACT

The antenna includes a main body, a first elastic film, a first medium, a curvature adjustment unit and at least one antenna unit. The first elastic film is adhered to the main body, and the first elastic film and the main body are encircled to form a first volume variable cavity. The first medium is filled in the first volume variable cavity, the first elastic film is elastically deformable according to a volume or pressure change of the first medium; the curvature adjustment unit is configured to adjust a curvature of the first elastic film through the volume or pressure change of the first medium; and the at least one antenna unit is adhered to an outer surface of the first elastic film and configured to receive or send a wireless signal. The beam direction of the antenna may be very flexibly changed in a large range.

17 Claims, 4 Drawing Sheets

(56) References Cited

U.S. PATENT DOCUMENTS

| | | | | |
|---|---|---|---|---|
| 6,031,506 | A | 2/2000 | Cooley et al. | |
| 6,664,939 | B1 * | 12/2003 | Olinyk | H01Q 15/142 29/600 |
| 6,897,832 | B2 * | 5/2005 | Essig, Jr. | E04H 15/20 343/912 |
| 7,382,332 | B2 * | 6/2008 | Essig, Jr. | F21S 11/00 343/878 |
| 7,937,983 | B2 * | 5/2011 | Yoshimura | B21D 11/20 72/380 |
| 8,418,687 | B2 * | 4/2013 | Capan | F24S 30/425 126/600 |
| 9,006,560 | B2 * | 4/2015 | Shelef | H01L 31/0547 136/246 |
| 9,575,222 | B2 * | 2/2017 | von Kries | B29D 11/00596 |

* cited by examiner

ANTENNA WITH RECONFIGURABLE BEAM DIRECTION AND ANTENNA ARRAY WITH RECONFIGURABLE BEAM SCANNING RANGE

CROSS-REFERENCE TO RELATED APPLICATIONS

This application is a continuation of International Patent Application No. PCT/CN2016/084970 with a filing date of Jun. 6, 2016, designating the United States, now pending. The content of the aforementioned applications, including any intervening amendments thereto, are incorporated herein by reference.

TECHNICAL FIELD

The disclosure relates to the technical field of antennas, and particularly relates to an antenna with a reconfigurable beam direction and an antenna array with a reconfigurable beam scanning range.

BACKGROUND OF THE PRESENT INVENTION

For a specific antenna, it is capable of receiving a beam from a certain direction in the space or radiating a beam from a certain direction to the space. In the prior art, there are two methods for changing the direction of the beam for the specific antenna. One method is to mechanically change a geometrical direction of the antenna; and the other method is to change current of the antenna through a phase shifter so as to radiate beams having different directivities in the space. An antenna array formed by adopting the first method is often called a mechanical antenna array, and for this antenna array, a space position and an angle of the antenna array are changed through mechanical movement, thereby changing a beam scanning range. An antenna array formed by adopting the second method is often called a phased array antenna, and for this antenna, the radiation or reception direction of the beam is changed through the phase shifter, thereby changing the beam scanning range. However, the mechanical antenna array has the defects that beam pointing direction is inflexible, rapid scanning is unable to be performed, service life is short and the like. The phased array antenna has the defects of complicated equipment structure, expensive cost and limited beam scanning range, with a maximum scanning angle of 90°~120°.

Thus, the antenna and the antenna array in the prior art each has some defects.

SUMMARY OF PRESENT INVENTION

Aiming at the above defects in the prior art, the disclosure provides an antenna with a reconfigurable beam direction and an antenna array with a reconfigurable beam scanning range.

For the above technical problems, the disclosure provides the following technical solutions.

In one aspect, an antenna with a reconfigurable beam direction is provided, which comprises: a main body, a first elastic film, a first medium, a curvature adjustment unit and at least one antenna unit; the first elastic film is adhered to the main body, and the first elastic film and the main body are encircled to form a first volume variable cavity; the first medium is filled in the first volume variable cavity, and the first elastic film is elastically deformable according to a volume or pressure change in the first medium; the curvature adjustment unit is configured to adjust a curvature of the first elastic film through the volume or pressure change in the first medium; the at least one antenna unit is adhered to an outer surface of the first elastic film and configured to receive or send a wireless signal.

Preferably, the first medium is liquid or colloid.

Preferably; the first medium contains a dopant.

Preferably the number of the antenna units is plural, and a plurality of antenna units are distributed on the outer surface of the first elastic film in order.

Preferably, the main body has an accommodation portion with an opening end; the first elastic film is configured to seal the opening end, thereby forming the first volume variable cavity.

Preferably, the main body has an accommodation portion with two opening ends; the antenna further includes a second elastic film; the two opening ends are sealed by the first and second elastic films respectively.

Preferably, the accommodation portion is respectively communicated with the two opening ends, and the first elastic film, the second elastic film and the main body are encircled to form the first volume variable cavity.

Preferably, the accommodation portion is internally provided with a partition configured to divide the accommodation portion into a first accommodation portion and a second accommodation portion which are not communicated; the first elastic film is configured to seal the first accommodation portion, thereby forming a first volume variable cavity; the second elastic film is configured to seal the second accommodation portion, thereby forming a second volume variable cavity.

Preferably, the partition and the main body are integrally formed.

Preferably, the second volume variable cavity is filled with a second medium; the curvature adjustment unit is further configured to adjust a curvature of the second elastic film through the volume or pressure change in the second medium.

Preferably, the second medium is identical to the first medium.

Preferably, the second medium is colloid or liquid.

Preferably, the main body has an accommodation portion, a plurality of partitions are arranged in the accommodation portion to divide the accommodation portion into a plurality of sub accommodation portions having opening ends; the antenna further includes a plurality of first elastic films; the plurality of first elastic films are respectively configured to seal the opening ends of the plurality of sub accommodation portions, thereby forming a plurality of volume variable cavities.

Preferably, the curvature adjustment unit is a unit for applying magnetic field, a unit for applying electric field or a unit for injecting or discharging medium.

In another aspect, an antenna array with a reconfigurable beam scanning range is provided, which comprises at least two antennas with reconfigurable beam directions.

DESCRIPTION OF THE DRAWINGS

In order to illustrate the technical solutions of embodiments of the disclosure or the prior art more clearly, drawings required to be used for describing embodiments or the prior art will be simply described in the following. Apparently, drawings in the following description are only some embodiments of the disclosure, and those of ordinary skill in the art can also obtain other drawings according to these drawings without any creative efforts.

DETAILED DESCRIPTION OF PREFERRED EMBODIMENTS

The technical solutions in embodiments of the disclosure will be clearly and completely described in the following with reference to accompanying drawings. Apparently, the described embodiments are only some embodiments of the disclosure rather than all the embodiments. Based on embodiments of the disclosure, all of embodiments obtained by those of ordinary skill in the art without any creative efforts belong to the protective scope of the disclosure.

First Embodiment

Figure 1:
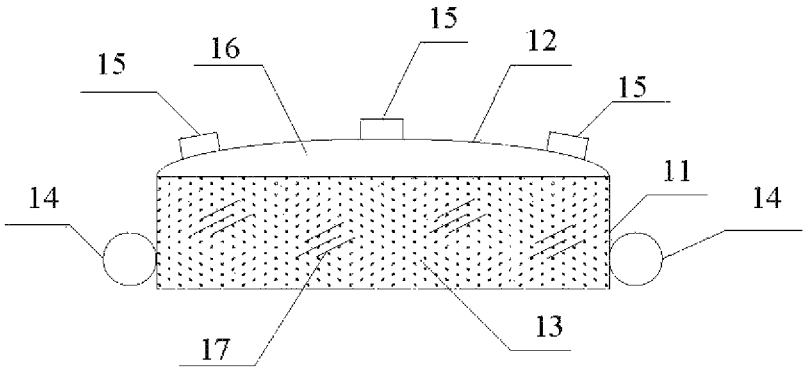
FIG. 1 is a structural diagram of an antenna according to a first embodiment of the disclosure.
Figure 2:
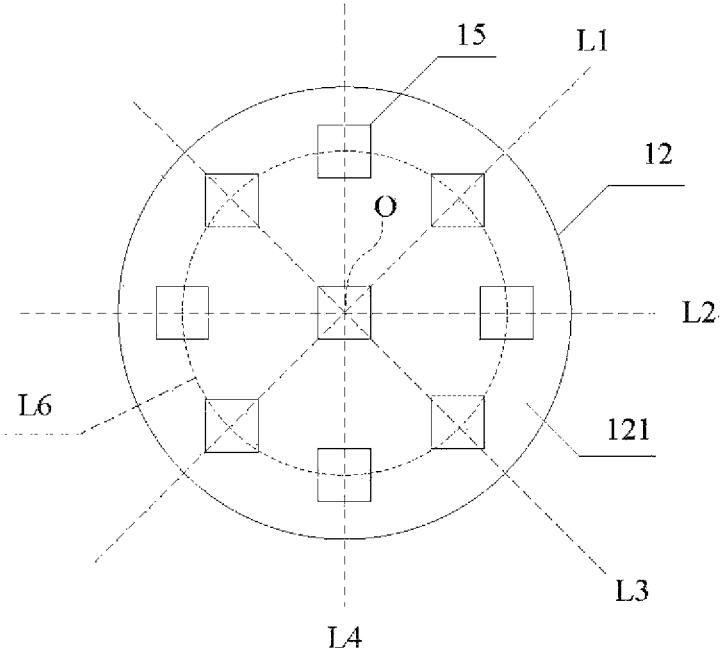
FIG. 2 is a top view of the antenna as shown in FIG. 1.
Figure 3:
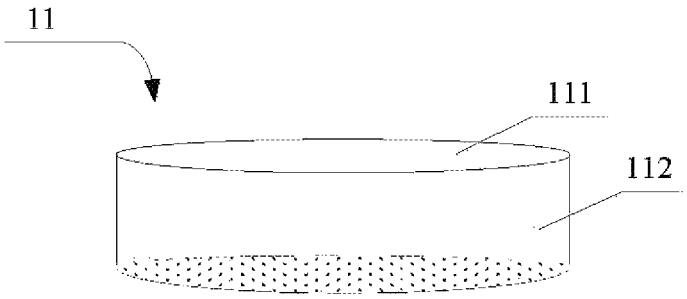
FIG. 3 is a structural diagram of a main body shown in FIG. 1.

Referring to FIGS. 1-3, this embodiment provides an antenna with a reconfigurable beam direction. The antenna includes: a main body 11, a first elastic film 12, a first medium 13, a curvature adjustment unit 14 and at least one antenna unit 15. The first elastic film 12 is adhered to the main body 11, and the first elastic film 12 and the main body 11 are encircled to form a first volume variable cavity 16. The first medium 13 is filled in the first volume variable cavity 16, and the first elastic film 12 is elastically deformable according to a volume or pressure change in the first medium 13. The curvature adjustment unit 14 is configured to adjust a curvature of the first elastic film 12 through the volume or pressure change of the first medium 13. The at least one antenna unit 15 is adhered to an outer surface 121 of the first elastic film 12 and configured to receive or send a wireless signal.

Further, the first medium 13 is liquid or colloid, such as water, a dielectric medium or a magnetic medium.

Further, as shown in FIG. 1, the first medium 13 may contain a dopant 17. The dopant may be used for changing the electric property or magnetic property of the first medium 13.

In this embodiment, the antenna unit 15 is arranged on the outer surface of the first elastic film 12, and therefore the direction of the antenna unit 15 changes with the change in the curvature of the first elastic film 12. For example, when more first medium 13 are filled in the first volume variable cavity 16, the curvature of the first elastic film 12 increases, and angles between the antenna units 15 located at two, sides and the antenna unit 15 located in the middle become larger, so the beam scanning range of the whole antenna is widened. On the contrary, when some of first mediums 13 are discharged from the first volume variable cavity, the curvature of the first elastic film 12 decreases. It is certainly that, when the first medium 13 is the electric medium, an electric field may be applied through the curvature adjustment unit 14 to change a pressure generated by the first medium 13, thereby changing the curvature of the first elastic film 12. When the first medium 13 is the magnetic medium, a magnetic field may be applied through the curvature adjustment unit 14 to change a pressure generated by the first medium 13, thereby changing the curvature of the first elastic film 12. All of the above three methods can achieve an effect of precisely adjusting the beam direction of the antenna. Furthermore, the direction of the antenna, according to this embodiment is adjusted without mechanical rotation, and reconfiguration of the beam scanning range is achieved without high cost.

Particularly, as shown in FIG. 3, the main body 11 has an accommodation portion 112. The accommodation portion 112 has an opening end 111. The first elastic film 12 is configured to seal the opening end 111, thereby forming the first volume variable cavity 16. The first elastic film 12 may be adhered to the main body 11 directly or through sealant. In a preferred embodiment provided by the disclosure, some reinforcement or protection devices are also arranged to ensure tight connection between the first elastic film 12 and the main body 11.

Further, as shown in FIG. 2, a plurality of antenna units 15 are arranged on the outer surface 121 of the first elastic film 12. The antenna units 15 are irregularly distributed on the first elastic film 12 at random. In preferred embodiment provided by the disclosure, the plurality of antenna units 15 are distributed on the outer surface 121 of the first elastic film 12 in order. For example, the antenna units 15 may be distributed either along one or two curves (for example, curves L1, L2, L3 or L4), or along a circumference (for example a circumference L6). Of course, several antenna units 15 may also be symmetrically distributed around a center point O.

Second Embodiment

Figure 4:
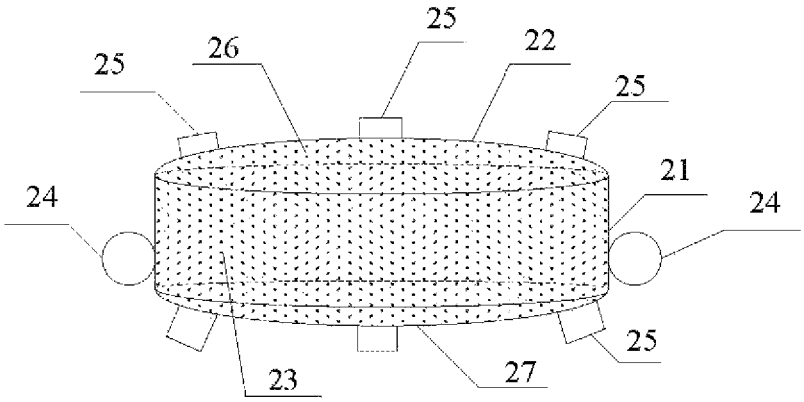
FIG. 4 is a structural diagram of an antenna according to a second embodiment of the disclosure.

This embodiment provides another antenna with a reconfigurable beam direction, as shown in FIG. 4. The antenna includes: a main body 21, a first elastic film 22, a first medium 23, a curvature adjustment unit 24, at least one antenna unit 25 and a second elastic film 27. The first elastic film 22 and the second elastic film 27 are adhered to the main body 21, and the first elastic film 22, the second elastic film 27 and the main body 21 are encircled to form a first volume variable cavity 26. The first medium 23 is filled in the first volume variable cavity 26, and the first elastic film 22 and the second elastic film 27 is elastically deformable according to a volume or pressure change of the first medium 23. The curvature adjustment unit 24 is configured to correspondingly adjust a curvature of the first elastic film 22 or the second elastic film 27 through the volume or pressure change of the first medium 23 or the second elastic film 27. The at least one antenna unit 25 is respectively adhered to an outer surfaces of the first elastic film 22 and the second elastic film 27 and configured to receive or send a wireless signal.

Further, the first medium 23 is liquid or colloid, such as water, a dielectric medium or a magnetic medium.

Further, as described in the above first embodiment, the first medium 23 may contain a dopant. The dopant can be used for changing the electric property or magnetic property of the first medium 23.

In this embodiment, a plurality of antenna units 25 are respectively arranged on the outer surfaces of the first elastic film 22 and the second elastic film 27, and therefore the beam scanning range of the antenna is even maximally adjusted to almost 360° by adjusting the thickness of the main body 21 and the curvatures of the first and second elastic films. Thus, through the antenna provided by the disclosure, the beam scanning range may be rapidly adjusted in a large range, so that the antenna of the disclosure is high in flexibility.

Figure 5:
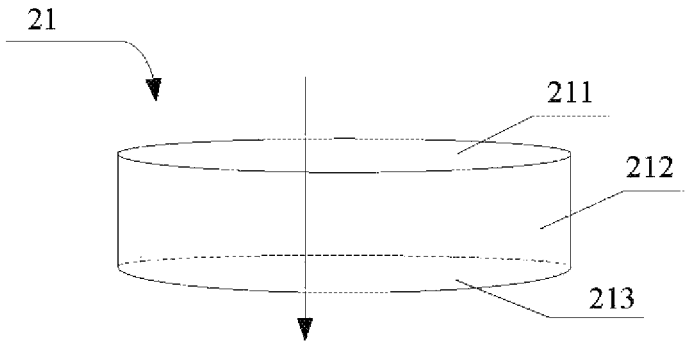
FIG. 5 is a structural diagram of the main body shown in FIG. 4 according to one embodiment of the disclosure.

Particularly, as shown in FIG. 5, the main body 21 has an accommodation portion 212. The accommodation portion 212 has two opening ends 211 and 213. The first elastic film 22 and the second elastic film 27 respectively seal the opening ends 211 and 213, thereby forming the first volume variable cavity 26. The first elastic film 22 and the second elastic film 27 may be adhered to the main body 21 directly or through sealant. In preferred embodiment provided by the disclosure, some reinforcement or protection devices are also arranged to ensure tight connection between the first elastic film 22 and the second elastic film 27 as well as the main body 21. The accommodation portion 212 is respectively communicated with the two opening ends 211 and 213, as indicated by arrows in FIG. 5, the upper opening end 211 is communicated with the lower opening end 213.

Figure 6:
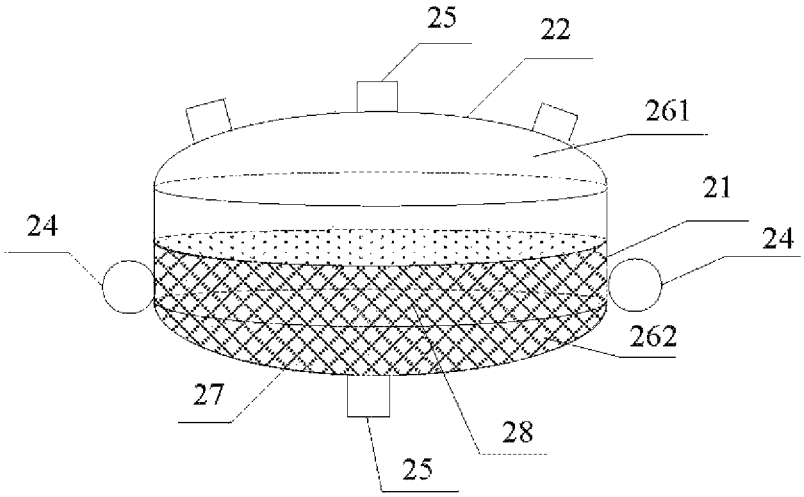
FIG. 6 is a structural diagram of an antenna according to the second embodiment of the disclosure.
Figure 7:
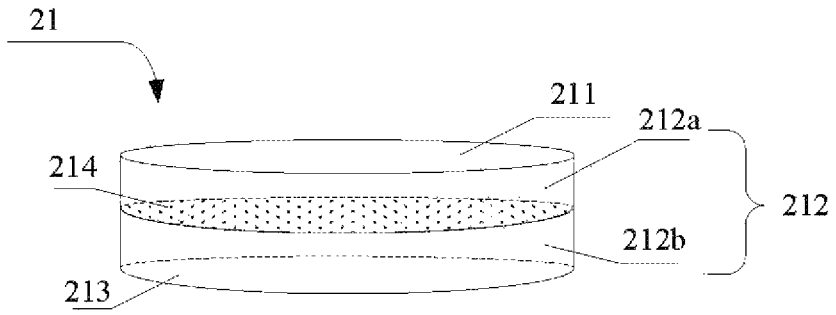
FIG. 7 is a structural diagram of the main body in FIG. 6.

Further, as shown in FIGS. 6 and 7, the accommodation portion 212 is further internally provided with a partition 214 configured to divide the accommodation portion 212 into a first accommodation portion 212*a* and a second accommodation portion 212*b* which are not communicated. The first elastic film 22 is configured to seal the first accommodation portion 212*a*, thereby forming a first volume variable cavity 261. The second elastic film 27 is configured to seal the second accommodation portion 212*b*, thereby forming a second volume variable cavity 262. The second volume variable cavity 262 is filled with a second medium 28. The curvature adjustment unit 24 is further configured to adjust a curvature of the second elastic film 27 through the volume or pressure change of the second medium 28.

The second medium 28 is identical to or different from the first medium 23. When it is needed to uniformly adjust the antenna units 25, the first medium 23 may be selected to be identical to the second medium 28. When it is needed to respectively adjust the first elastic film 22 and the second elastic film 27, the first medium 23 may be selected to be different from the second medium 28. For example, the first medium 23 may be selected as electric medium; the second medium 28 may be selected as magnetic medium. Of course, the quantity of the curvature adjustment units 24 may also be plural, and are configured to respectively adjust the curvatures of the first medium 23 and the second medium 28. It should be understood that the second medium 28 may be colloid or liquid.

Preferably the partition 214 and the main body 21 are integrally formed. In other embodiments provided by the disclosure, the partition 214 may also be in a detachable structure.

Third Embodiment

Figure 8:
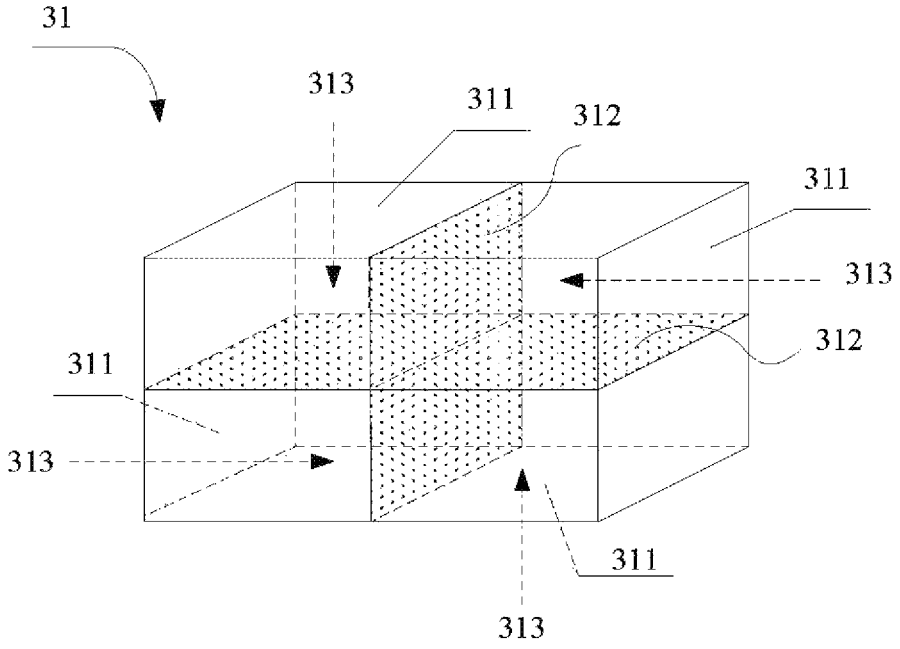
FIG. 8 is a structural diagram of a main body according to third embodiment of the disclosure.

Referring to FIG. 8, this embodiment provides a structural diagram of a main body. The main body 31 has an accommodation portion in which a plurality of partitions 312 are arranged to divide the accommodation portion into a plurality of sub accommodation portions 313 with opening ends 311. The antenna with a reconfigurable beam direction using this main body includes a plurality of elastic films (in combination with FIG. 4, such as elastic films 22 and 27). These first elastic films are respectively used for sealing the opening ends 311 of the plurality of sub accommodation portions, thereby forming a plurality of volume variable cavities (in combination with FIG. 6, such as volume variable cavities 262 and 261).

The antenna using this main body may include a plurality of antenna units which are respectively arranged on the plurality of first elastic films. These formed volume variable cavities are filled with one or more mediums. According to variety of the filled mediums, multiple curvature adjustment units may also be adopted, for example including a unit for applying magnetic field, a unit for applying electric field and a unit for injecting or discharging medium. Through corresponding curvature adjustment units, the volume or pressure of the medium is purposely changed.

It should be understood that the shape of the main body listed in embodiments of the disclosure is only for the purpose of describing the disclosure instead of limiting thereto. The structure of the main body of the disclosure may be of a cylinder, a cuboid or a sphere, and may also be of other irregular shapes.

Through arrangement of a plurality of elastic films, beam scanning ranges of antennas in various directions can be, separately controlled, so that the antennas can be suitable for application of multiple demands.

Fourth Embodiment

This embodiment provides another antenna array with a reconfigurable beam direction. The antenna array includes at least two antennas with a reconfigurable beam direction as described in any one of the first to third embodiments.

In this embodiment, the antenna array is composed of the at least two antennas with a reconfigurable beam direction so as to adjust the beam scanning range in all directions, which, especially, is suitable for a very large scale integration (VLSI). In the VLSI, arrangement of a mechanical antenna array is unrealistic, and adoption of, a phased array antenna is high in cost and high in power consumption. However, adoption of the antenna array of the present disclosure can achieve not only a large beam scanning range of an antenna like a mechanical antenna but also flexibility of the phased array antenna, and is low in cost and suitable for the VLSI.

The above description only illustrates some preferred embodiments of the disclosure, and thus cannot limit the claimed scope of the disclosure. Those of ordinary skill in the art can understand that all or partial procedures achieving the above embodiments and equivalent changes made according to the claims of the disclosure still belong to the scope of the disclosure.

I claim:

1. An antenna with a reconfigurable beam direction, comprising:

a main body, a first elastic film, a first medium, a curvature adjustment unit and at least one antenna unit, wherein, the first elastic film is adhered to the main body, and the first elastic film and the main body are encircled to form a first volume variable cavity;

the first medium is filled in the first volume variable cavity, and the first elastic film is elastically deformable according to a volume or pressure change of the first medium;

the curvature adjustment unit is configured to adjust a curvature of the first elastic film through the volume or pressure change of the first medium;

the at least one antenna unit is adhered to an outer surface of the first elastic film and configured to receive or send a wireless signal;

the main body has an accommodation portion with two opening ends; the antenna further comprises a second elastic film; the two opening ends are sealed by the first and second elastic films respectively;

the accommodation portion is internally provided with a partition configured to divide the accommodation portion into a first accommodation portion and a second accommodation portion which are not communicated; the first elastic film is configured to seal the first accommodation portion, thereby forming the first volume variable cavity; the second elastic film is configured to seal the second accommodation portion, thereby forming a second volume variable cavity.

2. The antenna according to claim 1, wherein, the first medium is liquid or colloid.

3. The antenna according to claim 2, wherein, the first medium contains a dopant.

4. The antenna according to claim 1, wherein, the number of the antenna unit is, plural, and a plurality of antenna units are distributed on the outer surface of the first elastic film in order.

5. The antenna according to claim 1, wherein, the partition and the main body are integrally formed.

6. The antenna according to claim 1, wherein, the second volume variable cavity is filled with a second medium; the curvature adjustment unit is further configured to adjust a curvature of the second elastic film through the volume or pressure change in the second medium.

7. The antenna according to claim 6, wherein, the second medium is identical to the first medium.

8. The antenna according to claim 6, wherein, the second medium is colloid or liquid.

9. The antenna according to claim 6, wherein, the curvature adjustment unit is a unit for applying magnetic field, a unit for applying electric field or a unit for injecting or discharging medium.

10. An antenna array with a reconfigurable beam scanning range, comprising at least two antennas according to claim 1.

11. An antenna with a reconfigurable beam direction, comprising:

a main body, a first elastic film, a first medium, a curvature adjustment unit and at least one antenna unit, wherein, the first elastic film is adhered to the main body, and the first elastic film and the main body are encircled to form a first volume variable cavity;

the first medium is filled in the first volume variable cavity, and the first elastic film is elastically deformable according to a volume or pressure change of the first medium;

the curvature adjustment unit is configured to adjust a curvature of the first elastic film through the volume or pressure change of the first medium;

the at least one antenna unit is adhered to an outer surface of the first elastic film and configured to receive or send a wireless signal;

the first medium contains a dopant.

12. The antenna according to claim 11, wherein, the first medium is liquid or colloid.

13. The antenna according to claim 11, wherein, the main body has an accommodation portion with two opening ends; the antenna further comprises a second elastic film; the two opening ends are sealed by the first and second elastic films respectively.

14. The antenna according to claim 13, wherein, the accommodation portion is internally provided with a partition configured to divide the accommodation portion into a first accommodation portion and a second accommodation portion which are not communicated; the first elastic film is configured to seal the first accommodation portion, thereby forming a first volume variable cavity; the second elastic film is configured to seal the second accommodation portion, thereby forming a second volume variable cavity.

15. An antenna with a reconfigurable beam direction, comprising:

a main body, first elastic films, a first medium, a curvature adjustment unit and at least one antenna unit, wherein, the first elastic film is adhered to the main body, and the first elastic film and the main body are encircled to form a first volume variable cavity;

the first medium is filled in the first volume variable cavity, and the first elastic film is elastically deformable according to a volume or pressure change of the first medium;

the curvature adjustment unit is configured to adjust a curvature of the first elastic film through the volume or pressure change of the first medium;

the at least one antenna unit is adhered to an outer surface of the first elastic film and configured to receive or send a wireless signal;

the main body has an accommodation portion, a plurality of partitions are arranged in the accommodation portion to divide the accommodation portion into a plurality of sub accommodation portions having opening ends; the first elastic films are respectively configured to seal the opening ends of the plurality of sub accommodation portions, thereby forming a plurality of volume variable cavities.

16. The antenna according to claim 15, wherein, the first medium is liquid or colloid.

17. The antenna according to claim 15, wherein, the first medium contains a dopant.

* * * * *